US005971604A

United States Patent [19]

Linga et al.

[11] Patent Number: 5,971,604

[45] Date of Patent: Oct. 26, 1999

[54] MIXING VALVE WITH ADJUSTABLE REGULATING ELEMENTS AND CENTRAL CHAMBER

[75] Inventors: Harald Linga, Trondheim; Gisle Onsrud, Vikhamar; Jan Richard Sagli, Trondheim, all of Norway

[73] Assignee: Sinvent A/S, Trondheim, Norway

[21] Appl. No.: 08/581,556

[22] PCT Filed: Jul. 13, 1994

[86] PCT No.: PCT/NO94/00125

§ 371 Date: Mar. 11, 1996

§ 102(e) Date: Mar. 11, 1996

[87] PCT Pub. No.: WO95/02448

PCT Pub. Date: Jan. 26, 1995

[30] Foreign Application Priority Data

Jul. 14, 1993 [NO] Norway ..... 932564

[51] Int. Cl.[6] ..... B01F 5/06

[52] U.S. Cl. ..... 366/340; 137/625.3; 138/46; 251/207

[58] Field of Search ..... 366/142, 336–340, 366/181.5, 176.1, 176.2; 137/625.3, 625.32; 251/207; 138/44, 45, 46

[56] References Cited

U.S. PATENT DOCUMENTS

| | | | |
|---|---|---|---|
| 2,621,012 | 12/1952 | Graham | 251/207 |
| 3,115,896 | 12/1963 | Roberts et al. | 251/207 X |
| 3,880,191 | 4/1975 | Baumann | 137/625.32 |
| 3,955,591 | 5/1976 | Baumann | 137/625.3 X |
| 4,150,693 | 4/1979 | Genevey et al. | 137/625.3 |
| 4,651,775 | 3/1987 | Okada | 137/625.3 X |
| 4,889,163 | 12/1989 | Engelbertsson | 137/625.32 |
| 4,994,242 | 2/1991 | Rae et al. . | |
| 5,070,909 | 12/1991 | Davenport | 137/625.32 |
| 5,287,889 | 2/1994 | Leinen | 137/625.3 |
| 5,556,200 | 9/1996 | Ekholm et al. | 366/181.5 X |

FOREIGN PATENT DOCUMENTS

| | | | |
|---|---|---|---|
| 2654769 | 6/1978 | Germany | 137/625.3 |
| 174015 | 3/1994 | Norway . | |
| 742662 | 7/1980 | U.S.S.R. | 251/207 |
| 2041035 | 9/1980 | United Kingdom . | |

*Primary Examiner*—Charles E. Cooley
*Attorney, Agent, or Firm*—Eckert Seamans Cherin & Mellott

[57] ABSTRACT

A mixer for a fluid flow in a pipe connection, especially for homogenizing a multiphase flow, has a housing to be inserted in the pipe connection for the fluid to flow through. In the housing there are at least one and preferably two or more adjoining and individually displaceable regulating elements having cooperating wall portions with flow passages. At an upstream side radial flow passages cause the fluid to converge into a central chamber. In the cooperating wall portions, a number of flow channels can be aligned or misaligned with one another and/or the inlet and outlet openings to regulate and control flow by movement of the regulating elements. The regulating elements also define a full cross-section opening at 90° to the flow passages, which can clear the passage between the inlet and outlet for passage of a pipe pig.

22 Claims, 10 Drawing Sheets

MIXING VALVE WITH ADJUSTABLE REGULATING ELEMENTS AND CENTRAL CHAMBER

BACKGROUND OF THE INVENTION

FIELD OF THE INVENTION

This invention relates to a mixer for mixing the components of a fluid flow in a pipe connection, in particular a multi-phase flow as e.g. fluids produced from an oil or gas well, comprising a housing adapted to be inserted in the pipe connection and to have the fluid flow running therethrough, whereby the housing comprises an inlet and an outlet opening respectively.

SUMMARY OF THE INVENTION

The invention has primarily been developed in connection with measurement of multi-phase mass flow, whereby the components can be e.g. oil, water and gas. By multi-phase flow there is here also meant cases in which only two phases are concerned, e.g. a liquid and a gas, or even when there is question of two liquids in one phase being conducted through the same pipe or the like. It will be realized however, that the mixer to be described in the following description, may also have other practical uses than in connection with mass flow measurement. Moreover when pipe connections are referred to here, this comprises both quite regular pipes connected to the input and output sides respectively of the mixer, and pipes or connections that can be more or less integrated into other equipment or devices, e.g. valves, pumps and so forth.

A mixer as stated in the introductory paragraph above, according to this invention has novel a specific features comprising in the first place that in the housing there is provided at least one moveable regulating element with wall portions associated with at least a downstream side of the housing and provided with a number of through-going flow channels, each of which has a substantially smaller cross-sectional area than the flow cross-sectional area at the inlet and outlet opening respectively, and that the regulating element is adapted to be moved in relation to the housing.

According to the fundamental solution stated above, the invention makes possible two main aspects, of which one aspect in the principle is bases on a rotational symmetry and mutual displacement of the regulating elements primarily by a rotary movement thereof. Another main aspect is directed to a basic planar arrangement of one or more regulating elements, whereby said movement thereof takes place by translational movement. The invention also comprises a measurement apparatus for mass flow as mentioned above, and the apparatus is based on a combination with the mixer described. A particular embodiment of the mixer according to the invention is intended for use in a freezing plant, heat pump system or the like as a gas-liquid distributor in association with an evaporator.

In the claims there are also recited additional novel and specific features related to both the mixer and the measurement apparatus.

The mixer according to the invention involves advantages inter alia by making possible control, either discretely by using only one or possibly several regulating elements, or continuously so that at any time it can be adjusted to the most favorable regulating position, with a resulting favorable degree of opening. This means that the no-slip condition to a highest possible degree can be fulfilled over a wide range of flow velocities. According to an embodiment the mixer can be set in a particular position (pigging position) that makes it possible to run a pipe pig therethrough. Moreover the mixer can be so designed that it is possible to mount it at any orientation being convenient in practice.

BRIEF DESCRIPTION OF THE DRAWINGS

In the following description the invention shall be explained more closely with reference to the drawings, in which.

DETAILED DESCRIPTION OF THE PREFERRED EMBODIMENTS

Figure 1:
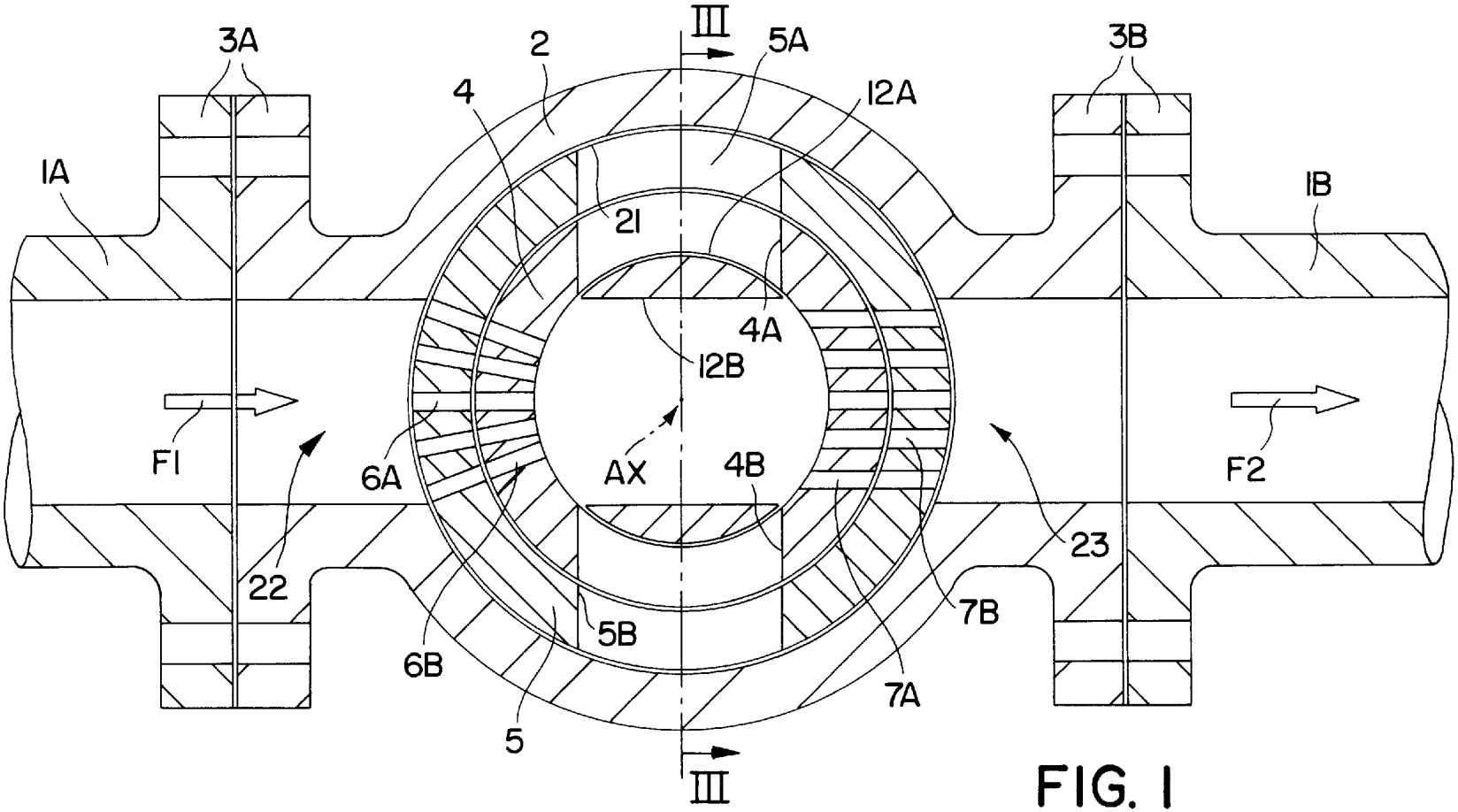
FIG. 1 shows an example of a first embodiment of the mixer according to the invention, as seen in axial longitudinal section normally to a common axis of rotation in the mixer.
Figure 2:
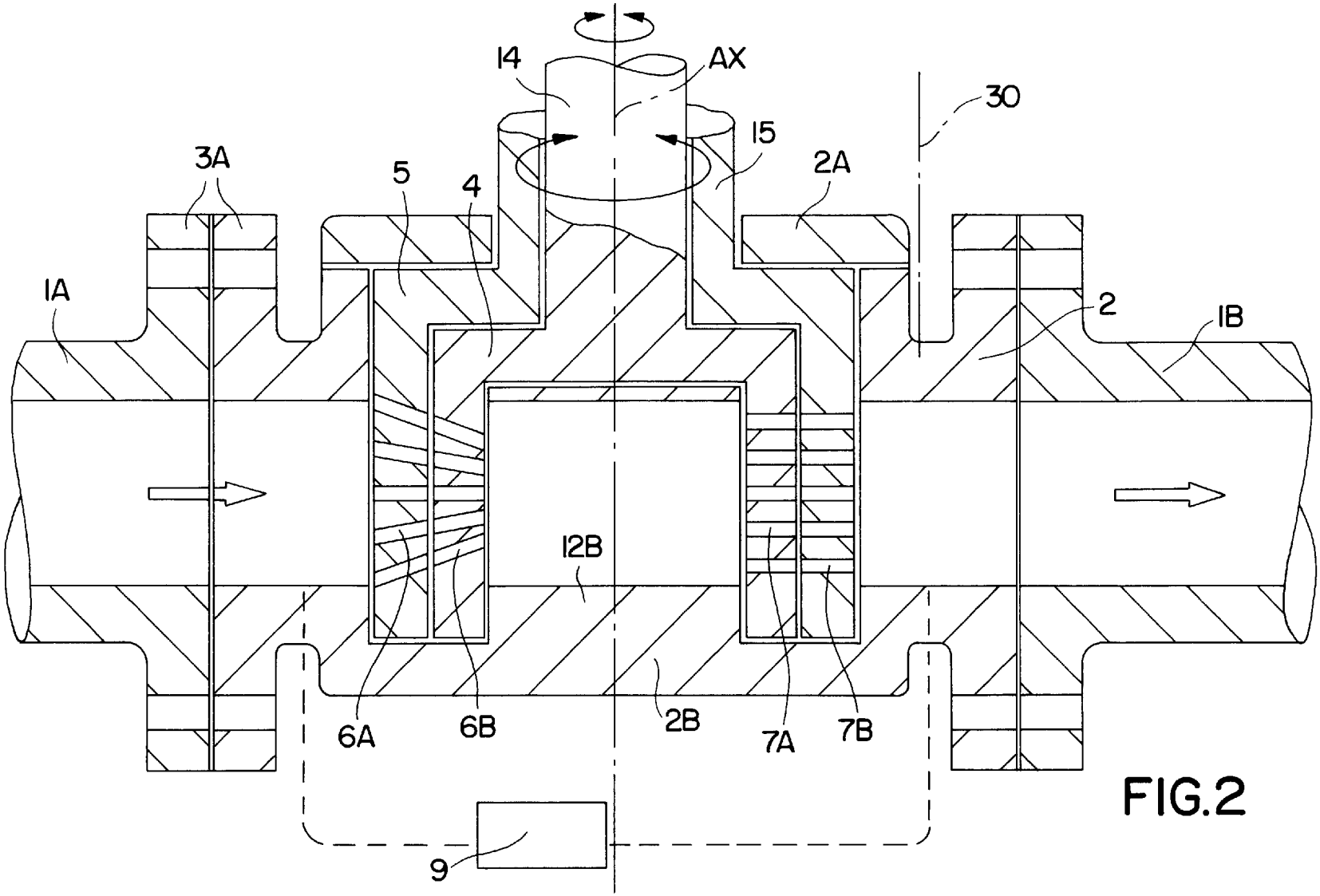
FIG. 2 shows the exemplary embodiment in FIG. 1, here also in axial longitudinal section, but coincident with said common axis of rotation.

In FIG. 1 and 2 of the drawings the pipe connection or main pipe concerned is represented by two pipe pieces 1A and 1B, which by means of flange connections 3A and 3B respectively, are connected to a housing 2 for the mixer, whereby the direction of fluid flow through the mixer is indicated with arrows F1 and F2 in FIG. 1. The housing 2 has an interior wall 21 that is substantially cylindrical and is broken by an inlet opening 22 and an outlet opening 23 respectively, which in turn are leading directly to the respective flange connections 3A and 3B.

In the housing 2 there are provided two regulating elements 4 and 5 which are co-axial and both have a cylindrical shape as the housing 2. These regulating elements 4 and 5 are individually rotatable in housing 2 and at the cylindrical casing or wall portions have perforations in the form of through-going flow channels upstream as shown at 6A and 6B, and downstream as shown at 7A and 7B. Between the inner wall 21 in housing 2 and the outside of one regulating element 5, and moreover between the inside of element 5 and the second regulating element 4, there are provided seals for the required fluid sealing. The common axis AX of housing 2 and the pair of regulating elements 4 and 5, in this example is oriented at a right angle to the general through-flow direction of the multi-phase flow, i.e. the longitudinal axis in FIG. 1 and 2. Embodiments may be contemplated however, wherein the common rotational AX and the longitudinal axis F1–F2 are not exactly normal to each other, but in all cases the common axis will lie broadly transversally to the longitudinal axis.

As to the shape of the regulating elements these need not be fully circular cylindrical as illustrated in the drawings, but can e.g. also be spherical, i.e. in principle the elements are in the form of rotational bodies. The casing or wall portions being provided with the flow channels 6A, B, 7A, B as referred to, are shown with a comparatively large wall thickness, which can be considered in relation to the flow channels, which preferably should have a substantially larger length than lateral dimensions.

At the upstream side the input flow channels 6A and 6B at the wall portions facing each other on the regulating elements 5 and 4, respectively, have a convergent orientation, so that they have a direction generally towards a central region within housing 2, a concentrated converging point being indicated exactly at the intersection between the common axis AX and the longitudinal axis F1–F2. This is to be considered as a more or less idealized case. At the other or downstream side the outgoing flow channels 7A and 7B are shown with a parallel orientation corresponding to the through-flow direction or longitudinal axis F1–F2. At this point it is remarked that by displacing the two regulating elements 4 and 5 from the rotary position they have according to the drawings, the configuration and orientation of the respective flow channels will of course be changed. In the rotary position shown in the drawings the flow channels both upstream and downstream are at one hand aligned with each other and on the other hand centered with respect to openings 22 and 23, so that the fluid through-flow can take place with the least possible flow resistance. Thus the drawings show the mixer in a fully open position, where the channels constitute a continuous and edge-free flow path through the casing or wall portions of the regulating elements. If the mixing effect aimed at is not obtained with this configuration, one or both regulating elements must be rotated so that the degrees of opening between the elements will be smaller. This results in a higher fluid velocity and a better fluid mixing in the passage between the elements, but also a higher flow resistance (pressure drop).

Figure 3:
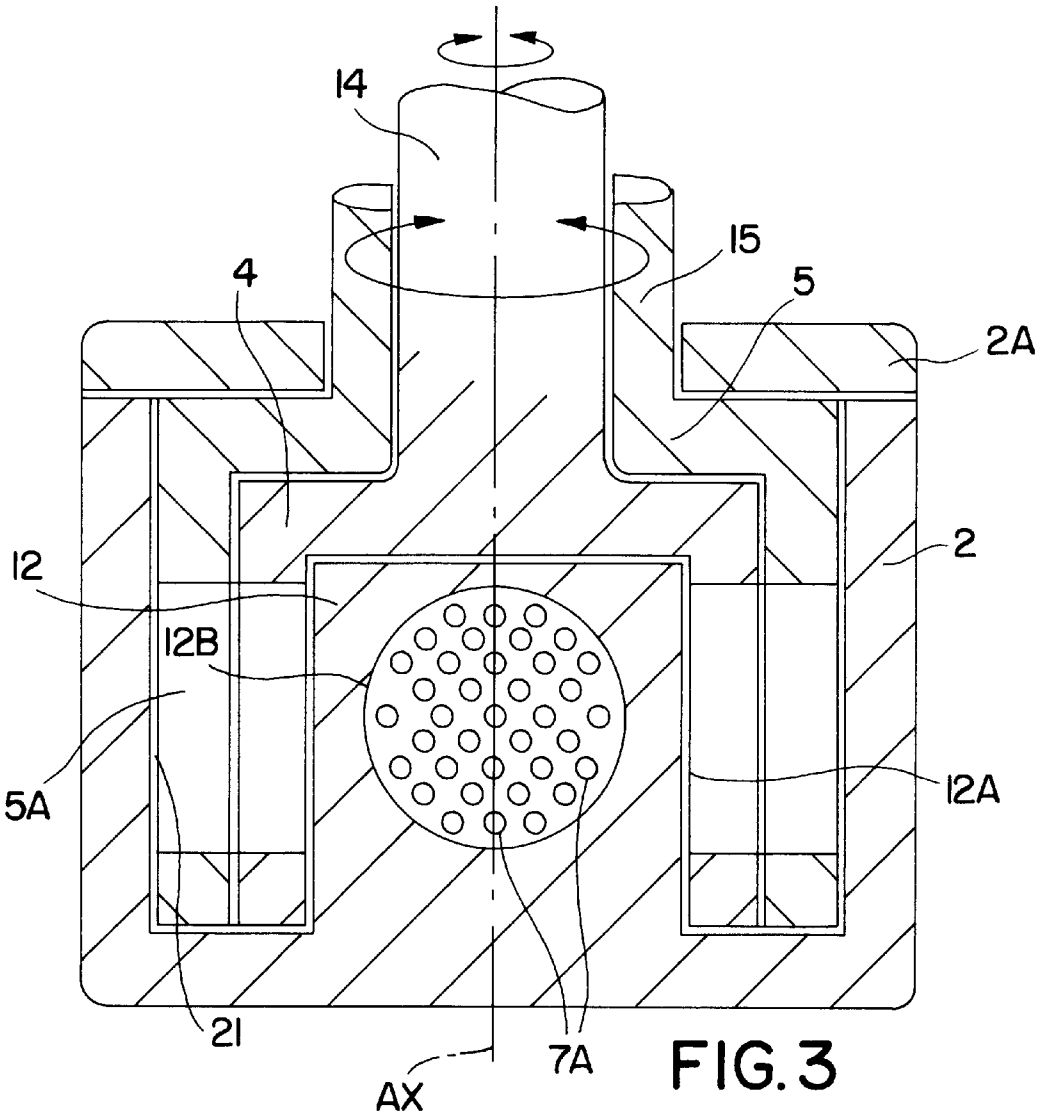
FIG. 3 shows a cross section of the mixer in FIG. 1 through the common axis of rotation, and FIG. 4 somewhat simplified shows a second embodiment of the mixer according to the invention in longitudinal section through a portion of a housing with two regulating elements therein.
Figure 10:
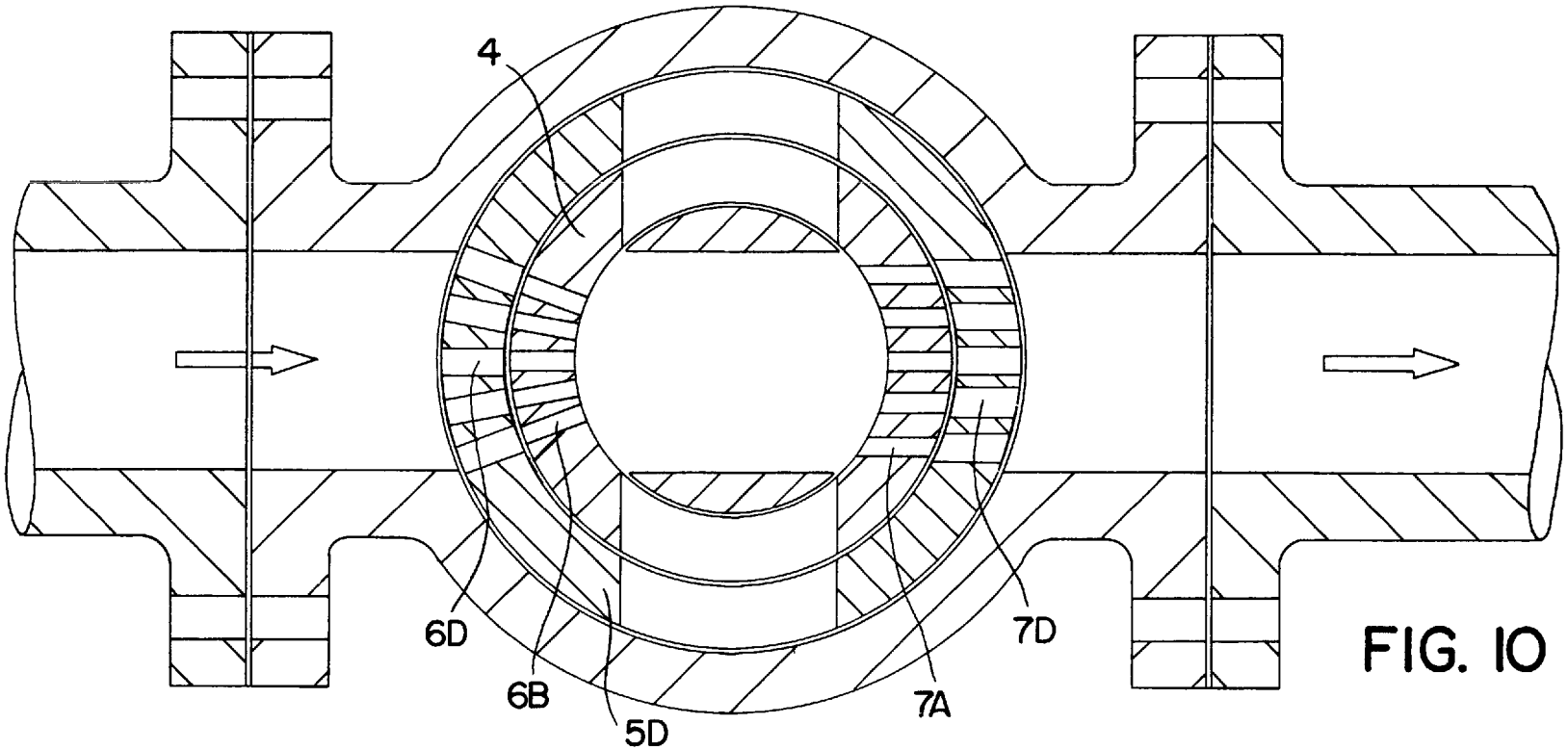
FIG. 10 shows a third modification of the embodiment of FIG. 1 and 2.

As will be seen from FIG. 3 the flow channels in this example, e.g. channels 7A, are designed with a circular cross section. According to FIG. 1 and 2 the cross section is the same throughout the whole length of each channel. However there are many possibilities of variation as regards the design of the flow channels, whereby one possibility is that these can have a more flattened or slit like cross-sectional shape, such as with the largest lateral extension in the circumferential direction of the wall portions of the regulating elements. Further the channels can be designed with a certain conicity in the longitudinal direction (see FIG. 10), perhaps in particular with a certain nozzle effect at the outlet ends towards the central space in housing 2, and towards the outlet opening 23 respectively from the housing. The flow channels 6A, 6B, 7A and 7B shown, have an approximate regular distribution over the total flow cross section of openings 22 and 23 as well as the adjoining pipe pieces or connections 1A and 1B, and such a regular distribution is considered to be the most favorable arrangement. This in particular applies to the output flow channels 7A and 7B. Under special circumstances however, it can be convenient to deviate from the regular distribution, in particular at the upstream side of the mixer. There is also a reason to note that each of the flow channels described, has a cross-sectional area being substantially smaller than the total cross-sectional area referred to with respect to openings 22 and 23. For the purpose of obtaining a larger capacity, i.e. a smaller flow resistance through the mixer, housing 2 can be designed with an expanded flow cross section towards one or both openings 22 and 23, so that the respective wall portions perforated with channels in each of the two regulating elements 4 and 5, could be enlarged correspondingly in area.

Figure 9:
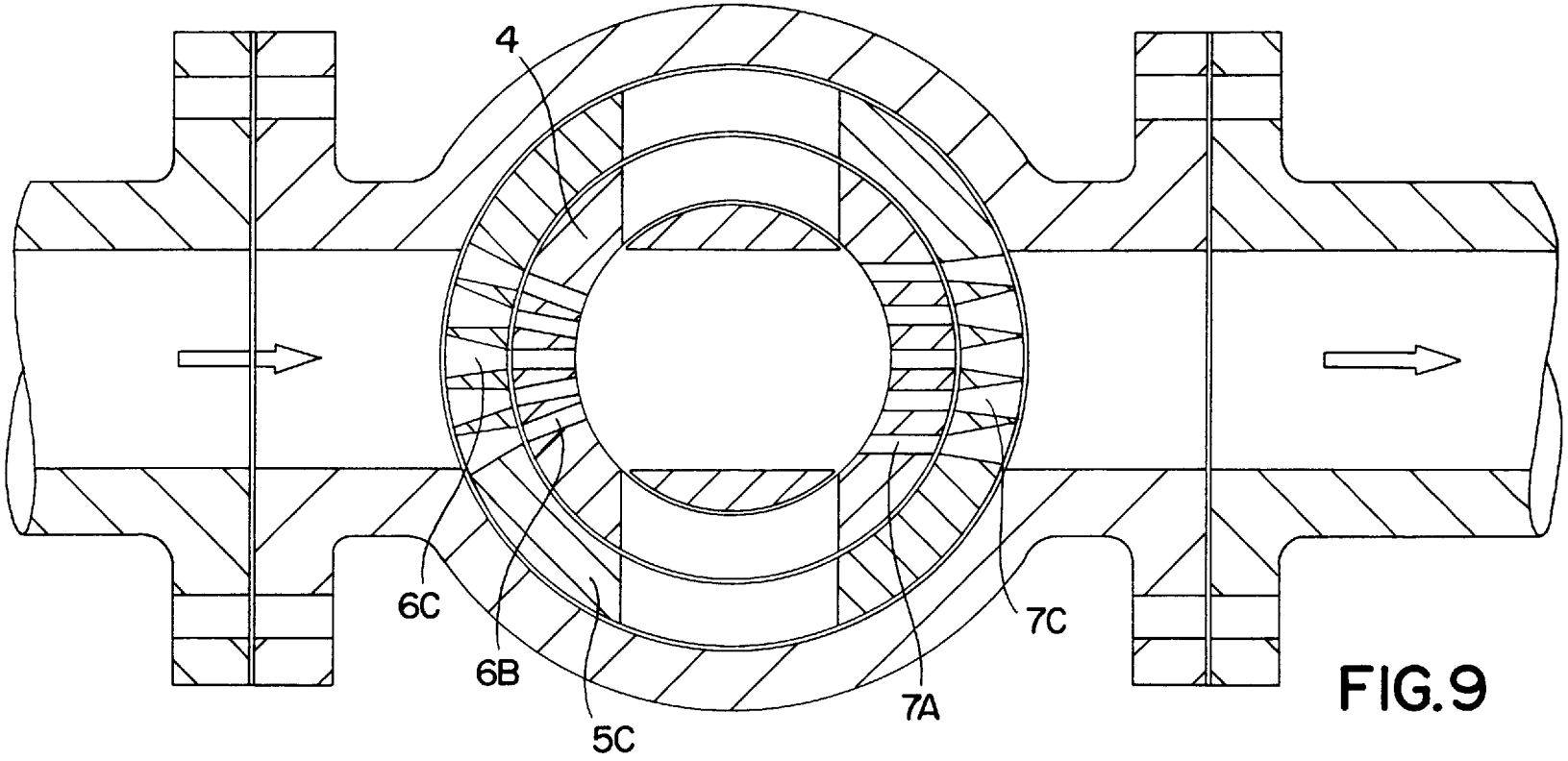
FIG. 9 shows another modification of the embodiment of FIG. 1 and 2.

Still another possibility with respect to the shape of the flow channels consists in that these can have unequal cross sections in the two cooperating regulating elements. FIG. 9 shows this modified embodiment, which corresponds to FIG. 1 except for the outer regulating element 5C having flow channels 6C and 7C with expanded cross sections, which means that they have larger cross sections than cooperating channels in the inner, adjacent regulating element 4. This involves inter alia, a regulating position for large flow velocities, where the regulating element 5C with the largest flow cross section is set in an operative position, i.e. mixing position, whereas the other regulating element 4 is set in its pigging position, i.e. with its large bore (to be described below) in the through-running position. At low flow velocities the regulation can be the opposite, i.e. with the narrower flow channels in mixing position and the larger flow channels rotated into an inoperative position. These variants and regulating positions show that the mixer can be designed with only one regulating element, e.g. provided thereby that the regulating elements 4 and 5 in FIG. 1–3 are integrated into one single element.

From FIG. 2 and 3 it is seen that the regulating element 4 has a spindle 14 and the regulating element 5 has a tubular spindle 15 being co-axial to spindle 14, so that rotation of the regulating elements mutually and with respect to housing 2 can be effected. In the simplest case the rotation can take place by means of manually operated controls, or possibly by means of drive devices such as actuators or the like, as being known e.g. in connection with valve operations. Spindles 14 and 15 extend out through a top cover 2A on housing 2.

With the structure described the degree of opening of the mixer can be controlled by rotating the inner regulating element 4 in relation to the outer regulating element 5, so that the flow channels through the wall portions of the elements are displaced with respect to each other. As a result there will be a larger or smaller narrowing of the flow cross-sectional area at the wall portions facing each other, i.e. at the interface between the two regulating elements, depending on the relative rotational position established. At a sufficiently large mutual rotation of the regulating elements, the passage through the flow channels will be completely closed.

In addition to the above mentioned, relatively narrow through-flow channels the two regulating elements 4 and 5 have bores 4A, 4B and 5A, 5B respectively, of diameter corresponding to the pipe diameter and the openings 22 and 23 (FIGS. 1 and 3). These bores have an axis lying generally at a right angle to the central axis of the respective wall portions with the flow channels. Thus, when the mixing function referred to shall not be established, i.e. with the mixer in the angular position as shown in the drawings, both regulating elements 4 and 5 in common can be rotated to a position in which the bores 4A, 4B, 5A, 5B coincide with openings 22 and 23. This leads to a substantially free and straight pipe section which inter alia makes it possible to run a pipe pig through the housing. For obtaining such a smooth through passage the housing 2 is provided with a plug-like core member 12, which can be adapted to sealingly cooperate with the internal side of regulating element 4 i.e. at the cylindrical outer wall 12A of the core member. Through the core member there is shown a bore 12B preferably aligned with and provided with the same flow cross section as the inlet opening 22 and the outlet opening 23.

The function of the mixer as described thus far, has to a large extent appeared from the preceding description, but at this point the following is additionally remarked: The forms of flow to be handled by the mixer can be rather arbitrary and varying, since there may be the question of laminar flow, plug flow, annular flow or dispersed flow, bubble flow or so-called churn flow. With some types of multi-phase flow a liquid component in particular will be located at the bottom of the input pipe 1A, whereas other components fill the remaining part of the flow cross section. The convergent orientation of the input flow channels 6A–6B as described, in such a situation will contribute to lifting the liquid component from the bottom of the pipe upwards, whereas gas or similar fluid components being located in the higher cross-sectional portions of pipe 1A and inlet opening 22, will be urged down towards the central region of the housing, i.e. within the bore 12B. This causes e.g. the two phases gas and liquid in such an incoming multi-phase flow to be spread over the flow cross section at the same time as an effective mixing takes place in the central region mentioned above. The liquid-gas mixture is further pressed out through the parallel outgoing flow channels 7A–7B at the downstream side of the mixer, which leads to a further homogenizing of the fluid components over the full flow cross section. Thus from the outgoing flow channels in this example, there will be discharged a mixture in which the liquid phase or phases are finely distributed in the gas, or depending on the proportion of gas fraction, the gas is finely distributed in the liquid or liquid mixture.

At the downstream side and in the pipe piece 1B connected to the mixer, there will accordingly be a flow in which the fluids are very well mixed and where the local gas fraction is approximately the same over the whole pipe cross section. Besides the two or three phases being present will have average velocities being very close to each other, i.e. near the no-slip condition. Adjustment of the degree of opening in the mixer by rotating the two regulating elements 4 and 5 in relation to each other, makes it possible to optimize the flow pattern so that the no-slip condition between liquid and gas will be fulfilled to a highest possible degree.

For the purpose of the primary use of the mixer described above, in connection with mass flow measurement as mentioned previously, there is in FIG. 2 at 30 indicated a radial plane downstream of the actual outlet opening 23 (and the mouth of the flow channels 7B), where a fraction gauge can be adapted to sense the magnitude or parameter of interest. The phase fractions may also be determined by measurement locally within the flow channels in the outer regulating element 5. At the location or the plane indicated at 30 the condition of equal velocity of the discharged liquid and gas will be best fulfilled under many circumstances. E.g. the fraction gauge can be a multi-energy gamma densitometer that measures the fractions of each individual fluid phase being present in the outgoing multi-phase flow.

Moreover in FIG. 2 there is shown a differential pressure sensor 9 being adapted to measure the pressure drop $\Delta P_m$ across the mixer, i.e. with a connection to the inlet at flanges 3A or opening 22 and a connection to the outlet at flanges 3B or opening 23. A more preferred upstream connection can be made, however, centrally within housing 2. Accordingly pressure sensor 9 will perform a differential pressure measurement over the outlet of the mixer and not over the mixer as a whole. In this section or part of the mixer the fluids are well mixed and the no-slip condition is substantially fulfilled. The most substantial portion of the pressure drop measured, will of course be present between the upstream side of channels 7A and the downstream side of channels 7B. The friction contribution of this pressure drop is proportional to the average density $\rho_m$ of the fluid mixture and to the square of the velocity $U_m$ of the mixture. By adjustment of the relative rotational position or angle between the two regulating elements 4 and 5, the pressure drop over the whole mixer is controlled, and simultaneously the flow conditions are changed so that the most favorable flow conditions at any time are obtained.

The average density is given by the densities and area fractions of the fluids. This together with the pressure drop measurement in unit 9 gives the velocity of the mixture. The mass flow of each individual fluid component then is found as the product of the fluid density, area fraction, pipe cross section and common velocity. This determination and calculation of mass flow is based upon principles being known per se, but anyhow shall be explained somewhat more in detail below.

Mass flow (in kg/s) of phase no. i is given by:

$$M_i = p_i A_i U_m \tag{1}$$

whereby $\rho_i$=density of fluid no. i (kg/m$^3$), $A_i$=cross-sectional area of fluid no. i and $U_m$=the average velocity (m/s) of the mixture.

In order to be able to employ the mixer described above, for measuring mass flow in multi-phase flow, the mixer must be used in combination with a fraction gauge. By means of a fraction gauge it is possible to determine the fractions of each individual fluid, i.e.

$$\gamma_i = A_i / A \tag{2}$$

Here $A_i$ is the area being covered by fluid no. i, and $$A = \sum_i A_i \tag{3}$$

is equal to the pipe cross section.

The fraction gauge is to be positioned where the fluids are well mixed. This can be at the downstream transition between regulating elements 4 and 5, within one of elements 4 and 5, or immediately downstream of the outlet opening, e.g. at 30 in FIG. 2 as mentioned above.

Such a fraction gauge for oil and water can e.g. be a multi energy gamma-densitometer (having two energy levels, where the decay coefficient of the gamma rays is different for oil and water with respect to at least one energy level) or a single energy gamma-densitometer in combination with an impedance gauge.

The friction contribution of this differential pressure, as calculated from measurement with unit 9 and with compensation for static pressure drop (the gravitation contribution), is proportional to the average density of the mixture and the square of the velocity of the mixture:

$$\frac{1}{2}\rho_m U_m^2 = k(\dot{a}, \mathrm{Re})\Delta P_m \tag{4}$$

so that the average velocity of the mixture will be $$U_m = \sqrt{2 \cdot k(\dot{a}, \mathrm{Re}) \cdot \Delta P_m / \rho_m} \quad (5)$$

$\rho_m$=the average density (kg/m$^3$) of the mixture $\Delta P_m$=the differential pressure over the mixer (Pa)

$\dot{a}$=the degree of opening=the lumen of (?) the channels/maximum lumen

Re=Reynolds number, being representative of the channels giving the largest contribution to the differential pressure measured, k($\dot{a}$, Re)=a factor being calibrated against the degree of opening and Reynolds number, The average density of the mixture $$\rho_m = \sum_i \gamma_i \rho_i \quad (6)$$

where $\rho_m$=density of fluid no. i and $\gamma_i$=the area fraction of fluid no. i (given by equation 2).

It is obvious that the choice of measuring device for the fraction measurements and the actual arrangement of such a gauge in association with the outlet from hosing 2, can be varied in many ways in relation to what is described and illustrated here. If e.g. a two phase flow is concerned, the fraction gauge can be an electrical capacitance element instead of being a gamma-densitometer. The position of the measuring device can be relatively close to the outlet opening 23, as indicated as 30, or the distance from the opening can be larger than illustrated in FIG. 2, e.g. with a distance corresponding to several interior diameters of the following pipe 1B. On the other hand cases may also be contemplated where a favorable position of the measuring device is at a radial section or plane through the outgoing flow channels 7B. Still another possibility is to have such measuring devices located at two or more positions within the range of distances mentioned here, so that a measuring device for the measurement or the measuring situation, can be selected by the operator.

In the case of a single phase flow where the density and viscosity of the fluid are known, velocity measurement can be performed directly according to equation (5) above, without the fraction measurement described.

In the embodiment shown in FIG. 1–3 there are described flow channels both upstream and downstream of the regulating elements 4 and 5. For some applications it may be sufficient to arrange pairs of cooperating flow channels 7A and 7B only at the outlet or downstream side, whereas the two regulating elements 4 and 5 at the upstream side must then be provided with large through flow openings corresponding approximately to the flow cross section of inlet opening 22, i.e. also corresponding to the lateral bores 4A, 4B and 5A, 5B respectively in both regulating elements, as described above. As an alternative flow channels at the inlet side can be provided only in one of the two regulating elements.

Another possible modification is to provide more than two co-axial regulating elements, such as a third and perhaps quite thin walled regulating element between the two elements being described and shown in the first embodiment of FIG. 1–3 of the drawings.

Figure 4:
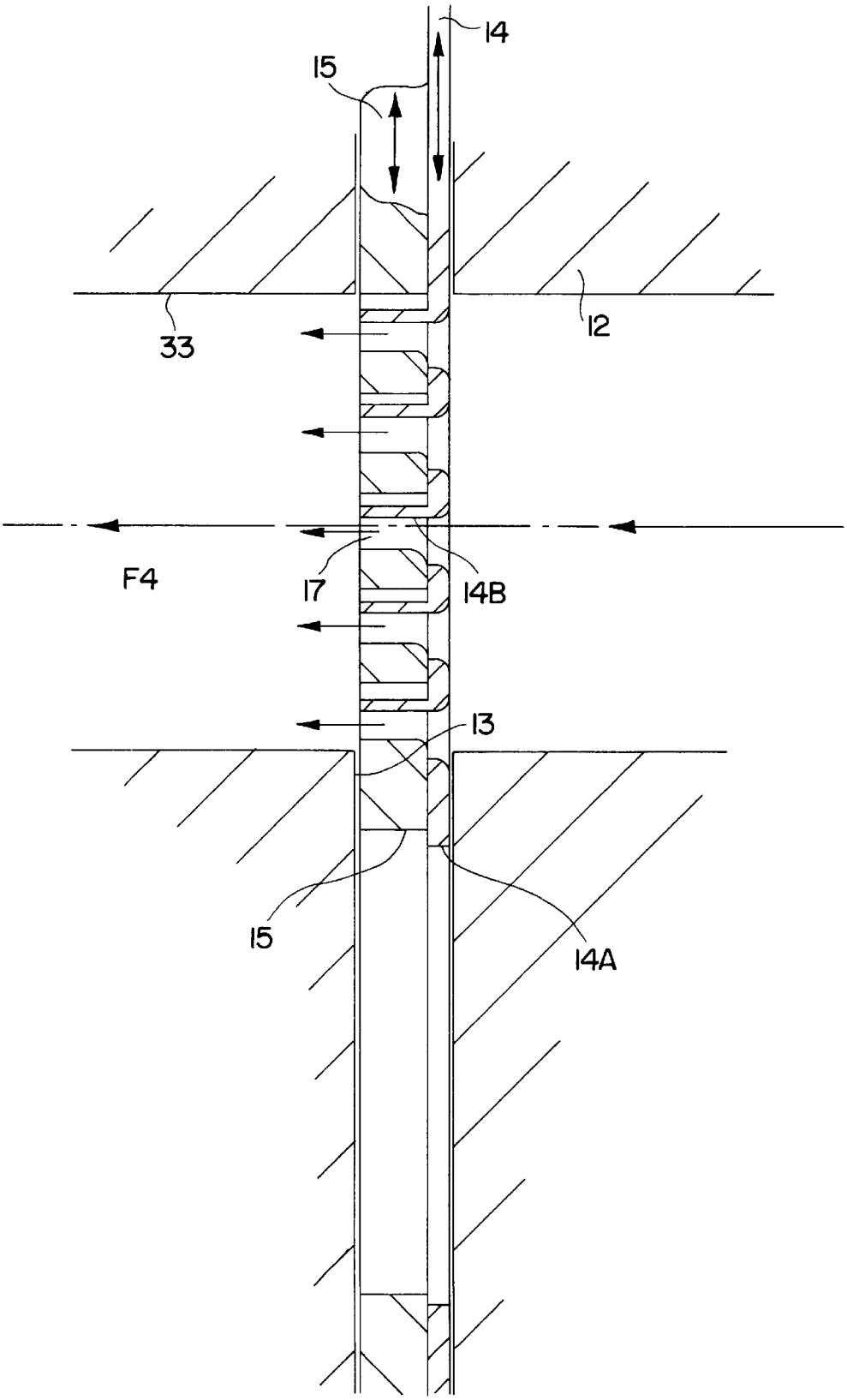
Figure 5:
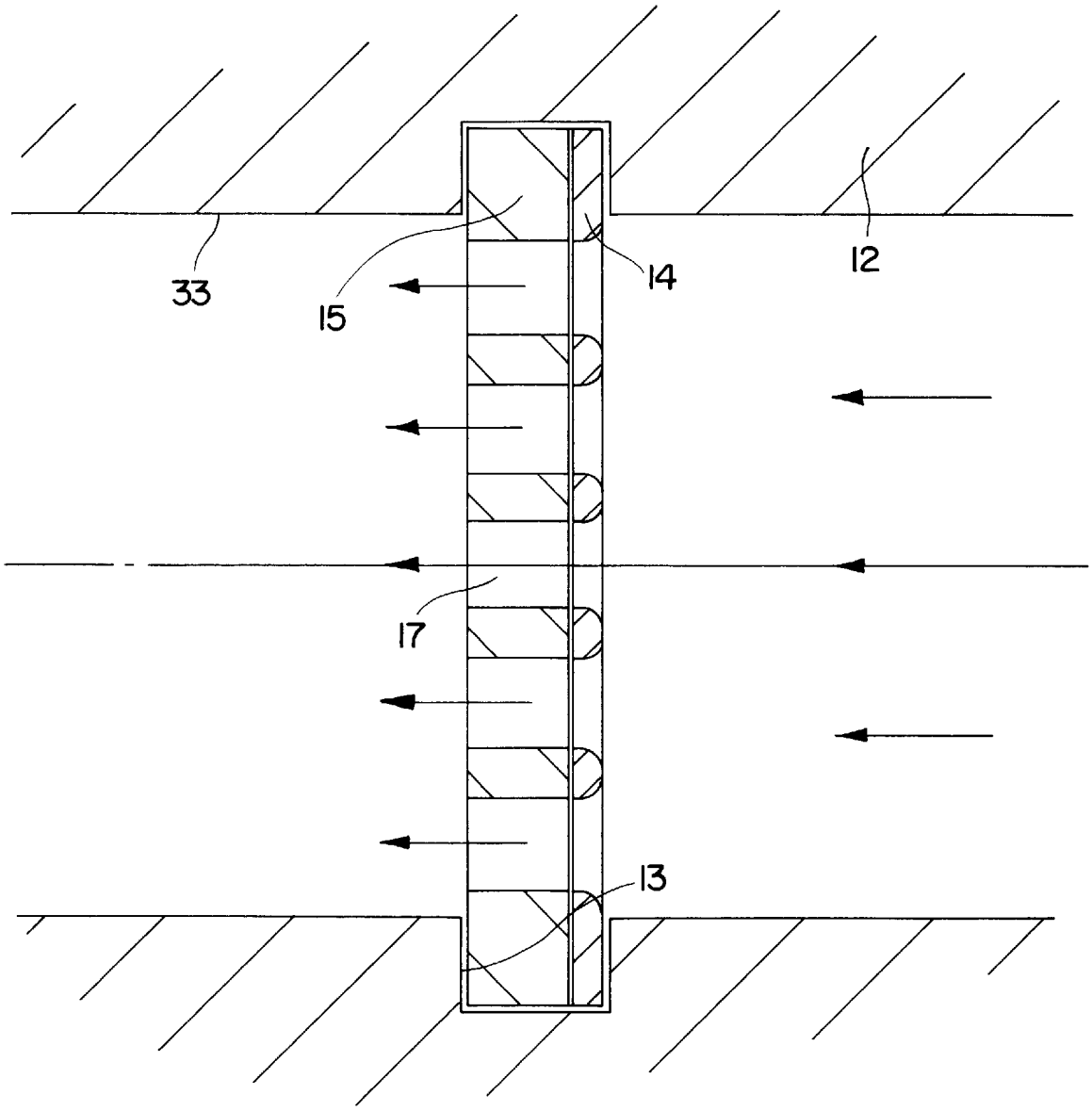
FIG. 5 shows a longitudinal section as in FIG. 3, but normally to the plane of section in FIG. 4.
Figure 6:
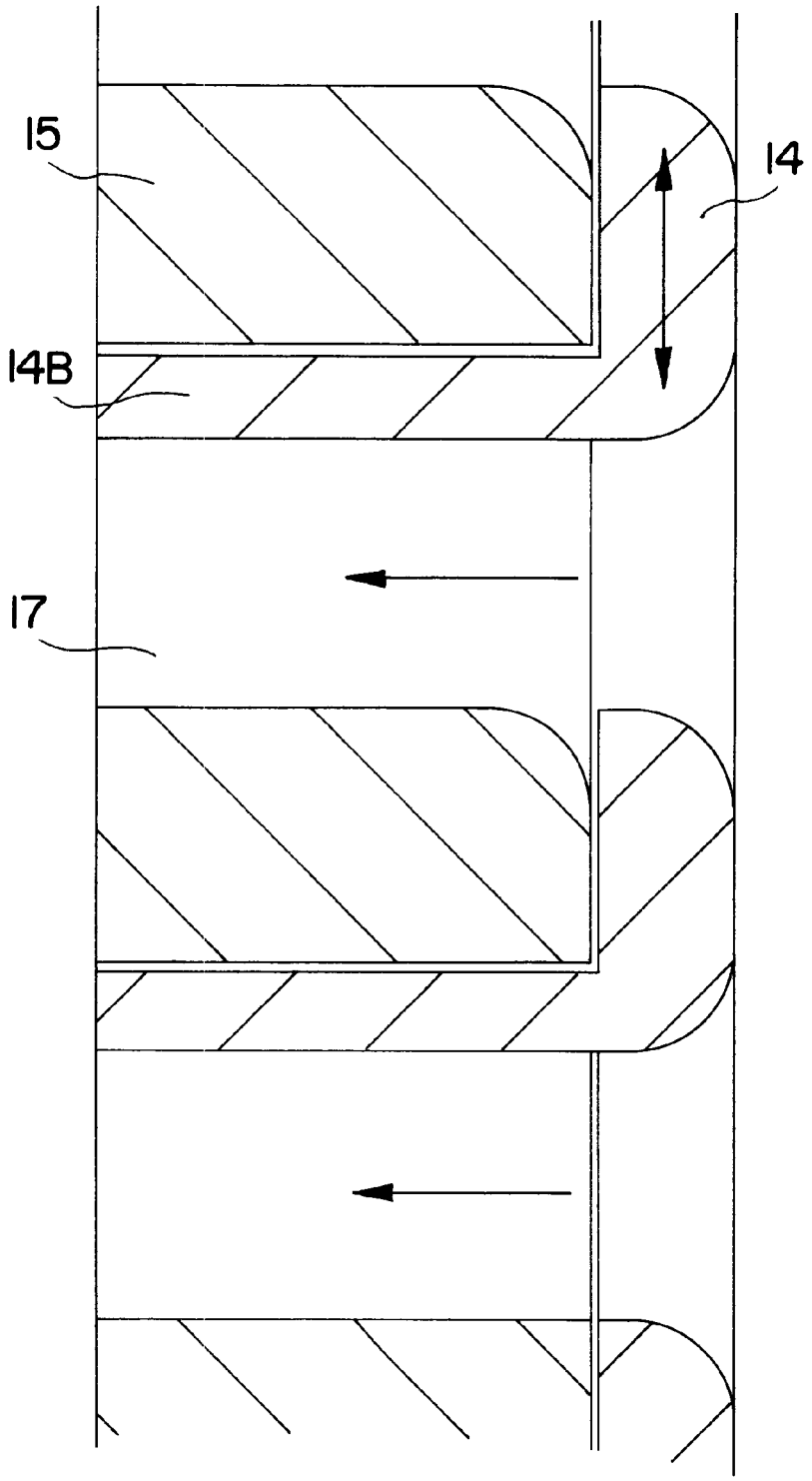
FIG. 6 shows an enlarged detail of the longitudinal section in FIG. 4, with the two regulating elements in a mutual position giving a maximum opening of the flow channels, FIG. 7 in a sectional view as in FIG. 3 shows a particular embodiment for employment in freezing plants, heat pump systems or the like, FIG. 8 shows a modification of the embodiment of FIG. 1 and 2.

Whereas the embodiment described above is based on rotational symmetry, the embodiment of FIG. 4–6 in principle is a planar arrangement of the regulating elements. In FIG. 4 only the downstream portion is shown of a housing 12 with two cooperating regulating elements 14 and 15, and a following outlet opening 33 that can e.g. be coupled to a pipe connection in a similar manner as outlet opening 23 in FIG. 1. Arrow F4 in FIG. 4 shows the direction of through flow.

At the top of the two (cut off) regulating elements 14 and 15 there are arrows showing the possibilities of displacing these elements. Thus elements 14 and 15 are arranged to be moveable in slits 13 in housing 12. See also FIG. 5.

Through regulating elements 14 and 15 there are provided a number of flow channels, of which one such channel 17 is indicated in FIG. 4, 5 and 6.

While the plate-like regulating element 15 is relatively thick, it is preferred that the cooperating element 14 is relatively thin, whereby the length of the individual flow channels 17 are determined substantially by the thickness of element 15. In the embodiment shown here the flow cross-sectional area of each channel 17 is adapted to be controlled simultaneously along the whole length of the channel. This is obtained by means of a tongue-like plate piece 14B which protrudes from the regulating element 14 into each channel 17 and forms one of the boundary surfaces thereof. In this connection it will be realized that each flow channel 17 most conveniently has a rectangular cross-sectional shape, so that a sufficiently good seal between the side edges of tongue piece 14B and the adjoining channel walls is obtained. FIG. 4 shows elements 14 and 15 in a mutual position where somewhat more than half of the maximum cross-sectional area of each channel 17 is open for fluid flow. FIG. 6 shows the maximum open position of elements 14 and 15, where tongue piece 14B with its inner side (upper side) is brought into engagement with one (upper) wall of the opening in element 15, which initially forms the flow channel 17.

In a complete mixer according to the invention a mixing chamber in housing 12 (at the right hand side of elements 14 and 15 in FIG. 4) normally will also have a further, corresponding set of regulating elements at the upstream or inlet side (not shown) in full analogy to the first and circular embodiment of FIGS. 1–3. As the first embodiment also the one in FIG. 4 has large bores 14A and 15A which upon appropriate displacement of elements 14 and 15 can be brought in line with the outlet opening 33, in particular for the purpose of pigging, as also explained in connection with the first embodiment above. For maximum opening in that case, elements 14 and 15 ought to be mutually displaced to a maximum open position as shown in FIG. 6, so that bores 14A and 15A will be completely aligned with each other. In contrast to the embodiment of FIGS. 1–3 the four regulating elements in such a mixer can be displaced and adjusted individually and independently of each other. In certain circumstances this can be an advantage.

Although the plate- or slide-like regulating elements 14 and 15 have been referred to as planar, the fundamental manner of function will still be the same if they were designed with a certain curvature, i.e. preferably with a curvature in the plane corresponding to the section of FIG. 5. The mutual displacement of elements 14 and 15 by translational movement, will be possible also in the latter case.

Figure 8:
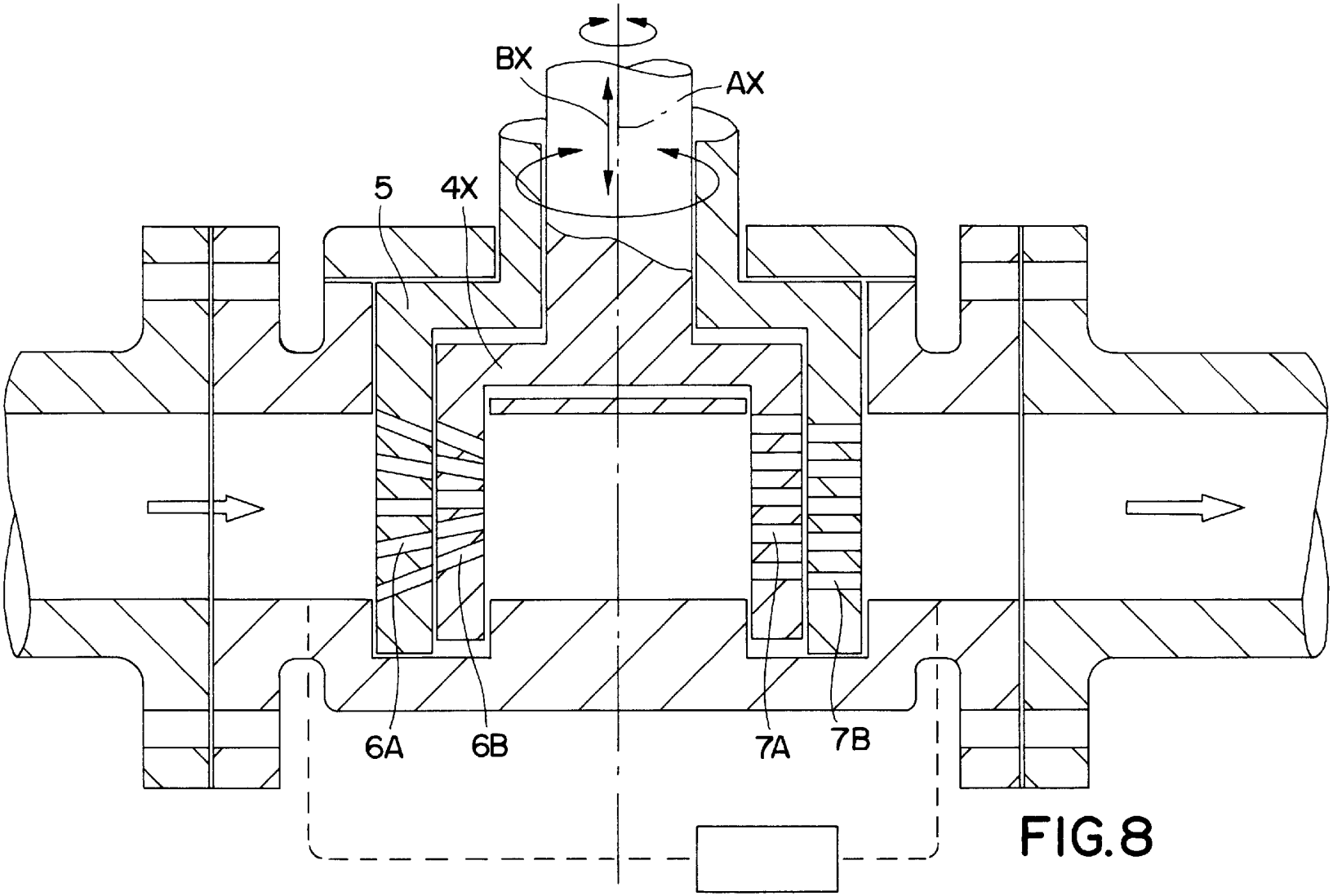

It will also be possible to modify the embodiment of FIGS. 1–3 so that this by translational movement, i.e. parallel to the axis AX, can provide for regulation of flow channels 6A–6B and 7A–7B respectively. For obtaining the pigging position, however, a rotary movement must be effected as explained previously. This modification can be seen from FIG. 8, where the whole design corresponds to FIG. 1 except for the inner regulating element 4X. This element is designed so as to make possible a certain axial translational movement, as illustrated with arrow BX.

Finally, it will be realized that the flow channels both in the first embodiment in FIGS. 1–3 and in the second embodiment of FIGS. 4–6, can be designed with a varying cross-sectional area, possibly cross-sectional shape, along its whole length or parts thereof. Thus, in FIG. 10 there is shown a modified outer regulating element 5D having conically narrowing channels 6D upstream and conically expanding channels 7D downstream. In other respects this embodiments correspond to the one in FIGS. 1 and 2. Moreover, the downstream portion of such flow channels can be provided with nozzle-like restrictions. Still another modification of the embodiment of FIGS. 1–3 and FIG. 10 consists in the variation of the flow cross-section along the whole length of the channels, by means of tongue-like plate pieces at one regulating element, as described for the embodiment of FIGS. 4–6. Such a modification of the first embodiment can also be implemented on the basis of a mutual rotation of the two regulating elements for adjustment of the flow conditions.

Figure 7:
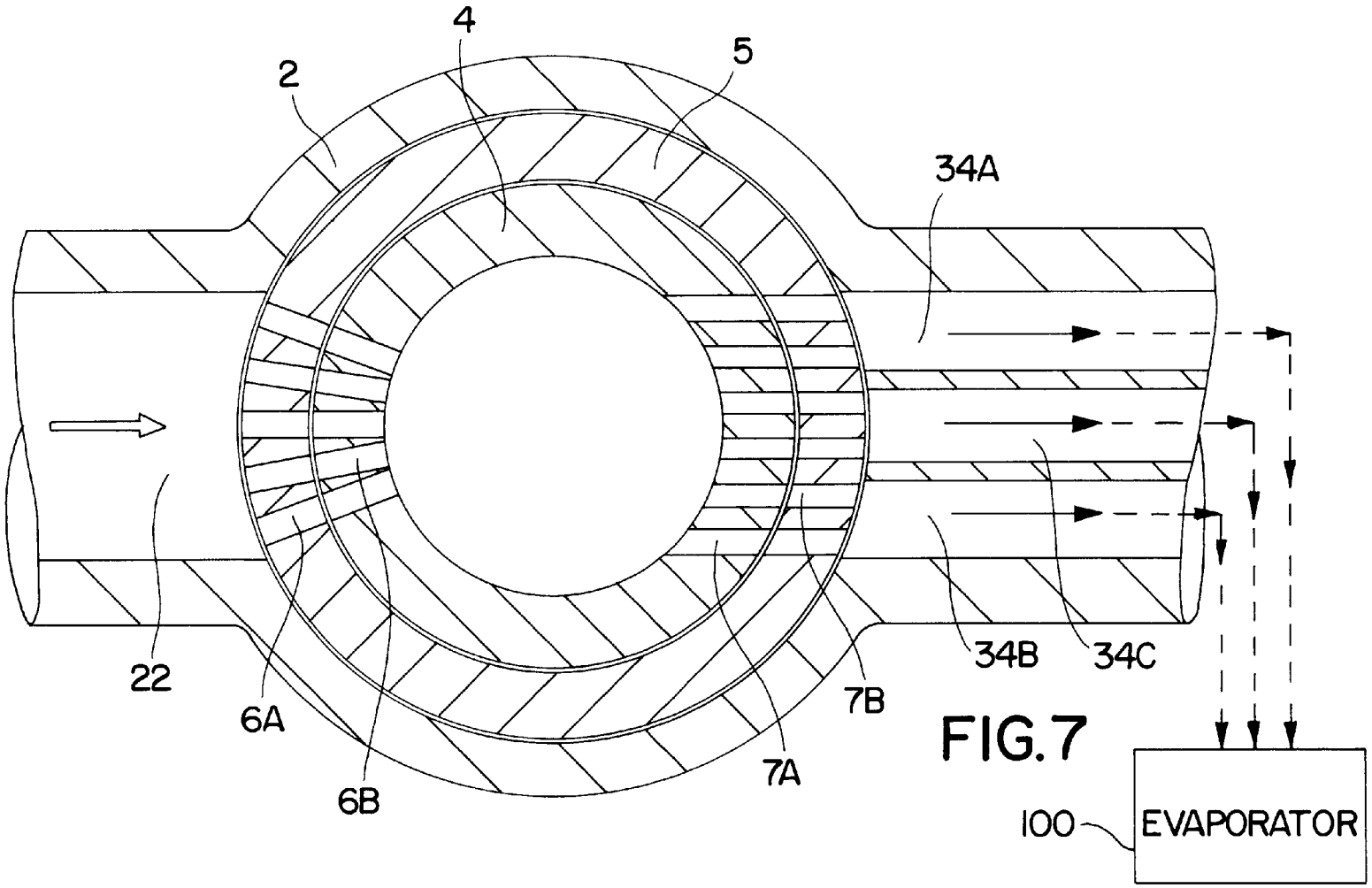

In the modified embodiment of FIG. 7, which is intended for use as a gas-liquid distributor in a freezing plant or heat pump system, the outlet comprises a number of outlet channels 34A, 34B, 34C to be lead to an evaporator with several inlets. These inlets correspond to the number of separate outlet channels 34A–C. There is here the question of a specific channel or pipe branching for the purpose of connection to respective evaporator inlets.

We claim:

1. Mixer for mixing the components of a fluid flow in a pipe connection, comprising a housing adapted to be inserted in the pipe connection for permitting fluid to flow therethrough in a flow direction, said housing comprising an inlet opening and an outlet opening each having a cross-sectional area, wherein the housing is provided with a first moveable regulating element formed with a through-bore and partially enclosing a central chamber, the first regulating element having a first wall portion directed in a normal operating position substantially toward the inlet opening on an upstream side of said housing and a second wall portion directed in said normal operating position substantially toward the outlet opening on a downstream side of said housing, said first wall portion being provided with a plurality of ingoing flow channels, and said second wall portion being provided with a plurality of outgoing flow channels and wherein the through-bore has a cross-sectional area corresponding substantially to the cross-sectional area of each of the inlet and outlet openings, said flow channels each having a substantially smaller cross-sectional area than the cross-sectional area of each of the inlet and outlet openings respectively, and wherein the first regulating element is moveable in relation to said housing for selectively orienting part of the ingoing and outgoing flow channels toward the inlet opening and the outlet opening, respectively, and part of said flow channels toward the housing, whereby mixing is effected in the central chamber, between the inlet opening and the outlet opening and wherein the first regulating element is selectively movable to align the through-bore with the inlet and outlet openings for a substantially free through-flow without mixing effect.

2. Mixer according to claim 1, wherein said housing has internal walls substantially defining rotational surfaces broken by said inlet and outlet openings respectively, said first regulating element being co-axial with and rotatable in the housing, and being shaped as a rotational body having a common axis with the housing, said common axis being oriented laterally relative to the flow direction, at least one of said ingoing and outgoing flow channels being substantially radial to the common axis and oriented by rotation of the first regulating element to face one of the inlet and outlet openings and upon said rotation selectively to be blocked from said inlet and outlet openings by the housing.

3. Mixer according to claim 2, wherein said housing interiorly comprises a central core member partially enclosed by said first regulating element, the core member having a through-bore aligned with and having a flow cross-sectional area substantially equal to the cross-sectional area of the inlet and outlet openings respectively.

4. Mixer according to claim 1, wherein said first regulating element is rotatable in the housing and said through-bore extends through said first regulating element to open at diametrically opposite wall portions, the through-bore being oriented at approximately 90°, about a common rotational axis with said housing and said first regulating element, from said wall portions having said outgoing flow channels.

5. Mixer according to claim 1, wherein at least some of said flow channels have varying cross-sectional areas, along at least part of their length.

6. Mixer according to claim 1, further comprising structures subdividing said outlet opening to define a number of outlet channels, whereby the mixer is applicable to one of a freezing plant and a heat pump system having an evaporator with a corresponding number of evaporator inlets.

7. Mixer according to claim 1 further comprising a measuring apparatus comprising a differential pressure sensor coupled to the housing for measuring a pressure drop at least partially over a flow path between the inlet opening and the outlet opening, for use in calculating mass flow.

8. Mixer according to claim 7, wherein the differential pressure sensor is coupled to measure the pressure drop between the central chamber and said outlet opening.

9. Mixer according to claim 7, further comprising a fraction measuring device coupled to said outlet opening for measuring a multi-phase flow.

10. Mixer for mixing the components of a fluid flow in a pipe connection, comprising a housing adapted to be inserted in the pipe connection for permitting fluid to flow therethrough in a flow direction, said housing comprising an inlet opening and an outlet opening each having a cross-sectional area, wherein the housing is provided with at least first and second regulating elements partially enclosing a central chamber, each of said first and second regulating elements having a first wall portion directed in a normal operating position substantially toward the inlet opening on an upstream side of said housing and a second wall portion directed in said normal operating position substantially toward the outlet opening on a downstream side of said housing, said first and second wall portions being provided with a plurality of ingoing and outgoing flow channels, respectively, said flow channels each having a substantially smaller cross-sectional area than the cross-sectional area of the inlet and outlet openings respectively, the first and second regulating elements being moveable in relation to said housing for selectively orienting part of the ingoing and outgoing flow channels toward the inlet opening and the outlet opening, respectively and individually mutually displaceable laterally relative to the fluid flow for selectively opening and closing serial flow channels defined by the regulating elements and passing from the inlet opening, through selectively aligned ones of the ingoing flow channels of the regulating elements, through the central chamber, and through selectively aligned ones of the outgoing flow channels of the regulating elements to the outlet opening, whereby mixing is effected in the central chamber, between the inlet opening and the outlet opening.

11. Mixer according to claim 10, wherein said housing has internal walls substantially defining rotational surfaces broken by said inlet and outlet openings respectively, said first and second regulating elements being co-axial with and rotatable in the housing and relative to one another, the regulating elements being shaped as rotational bodies having a common axis with the housing, said common axis being oriented laterally relative to the flow direction, at least one of said ingoing and outgoing flow channels being substantially radial to the common axis and oriented by rotation of the respective one of the first and second regulating elements to face one of the inlet and outlet openings and upon said rotation selectively to be blocked from said inlet and outlet openings by the housing, wherein said at least first and second regulating elements partially enclose each other, said wall portions with said flow channels having mutual fluid sealing such that said movable regulating elements are rotatable to assume a position in which at least some of said ingoing and outgoing flow channels in one said regulating element are aligned with said flow channels in another said regulating element.

12. Mixer according to claim 11, wherein said first and second regulating elements are individually rotatable for mutual displacement of the regulating elements.

13. Mixer according to claim 11, wherein said first and second regulating elements are coupled with rotating coaxial spindles extending to a same side of said housing.

14. Mixer according to claim 10, wherein said first and second regulating elements are mutually displaceable in an axial direction for aligning the ingoing and outgoing flow channels.

15. Mixer according to claim 10, wherein said first and second regulating elements are plate-shaped and are mutually displaceable by translational movement.

16. Mixer according to claim 15, wherein the first and second regulating elements comprise two adjacent regulating elements at said upstream side for said inlet opening and two adjacent regulating elements at said downstream side for said outlet opening, and wherein each said adjacent regulating element is individually displaceable.

17. Mixer according to claim 10, wherein said ingoing and outgoing flow channels of said first and second regulating elements open at said first and second wall portions on substantially diametrically opposite upstream and downstream sides, at least the ingoing flow channels being generally radial and each having a cross-sectional area substantially smaller than the cross-sectional area of the inlet and outlet openings respectively, such that flow converges in the central chamber.

18. Mixer according to claim 17, wherein each of said first and second regulating elements are provided with ingoing flow channels, and wherein at least some of the ingoing flow channels in one of said first and second regulating elements are alignable in one angular position with the ingoing flow channels in the other of said second first and second regulating elements.

19. Mixer according to claim 18, wherein at least some of the flow channels in one of said first and second regulating elements have a larger cross-sectional area than at least some of the flow channels in another of said first and second regulating elements.

20. Mixer according to claim 17, wherein said outgoing flow channels are substantially parallel to each other and are regularly distributed over said wall portions of said first and second regulating elements.

21. Mixer according to claim 10, wherein at least one of said first and second regulating elements comprises a plate piece having tongue-like pieces extending into the flow channels along a substantial length of an internal cross-section of the flow channels of the other of the first and second regulating elements, whereby displacement of one of said first and second regulating elements regulates the internal cross-sectional area of said flow channels of said other of the first and second regulating elements along said substantial length.

22. Mixer according to claim 21, wherein said plate piece is relatively thin and said tongue-like pieces protrude into and form a longitudinal boundary surface through substantially a whole length of the flow channels in another of said first and second regulating elements, and wherein said flow channels have a rectangular cross-sectional shape.

* * * * *